US008547194B2

(12) United States Patent
Tseng et al.

(10) Patent No.: US 8,547,194 B2
(45) Date of Patent: Oct. 1, 2013

(54) INDUCTANCE MODULE AND BASE HOLDER THEREOF

(75) Inventors: Hsiang-Yi Tseng, Taoyuan County (TW); Ching-Hsiang Tien, Taoyuan County (TW)

(73) Assignee: Delta Electronics, Inc., Taoyuan County (TW)

( * ) Notice: Subject to any disclaimer, the term of this patent is extended or adjusted under 35 U.S.C. 154(b) by 0 days.

(21) Appl. No.: 13/482,522

(22) Filed: May 29, 2012

(65) Prior Publication Data

US 2012/0319810 A1 Dec. 20, 2012

(30) Foreign Application Priority Data

Jun. 15, 2011 (TW) ..... 100120868 A

(51) Int. Cl.
*H01F 27/02* (2006.01)
*H01F 27/06* (2006.01)

(52) U.S. Cl.
USPC ..... 336/90; 336/65

(58) Field of Classification Search
USPC ..... 336/65, 66, 67, 68, 90
See application file for complete search history.

(56) References Cited

U.S. PATENT DOCUMENTS

| | | | | | |
|---|---|---|---|---|---|
| 3,191,131 | A * | 6/1965 | Adams et al. | ..... | 333/167 |
| 4,451,867 | A * | 5/1984 | Robertson | ..... | 361/248 |
| 5,670,924 | A * | 9/1997 | Heinrich | ..... | 336/61 |
| 5,929,735 | A * | 7/1999 | Heinrich | ..... | 336/61 |
| 6,144,278 | A * | 11/2000 | Nishida et al. | ..... | 336/92 |
| 6,336,818 | B1 * | 1/2002 | Bayer | ..... | 439/78 |
| 6,437,673 | B1 * | 8/2002 | Nishida et al. | ..... | 336/90 |
| 2005/0012413 | A1 * | 1/2005 | Bott et al. | ..... | 310/71 |

* cited by examiner

*Primary Examiner* — Mohamad Musleh
*Assistant Examiner* — Joselito Baisa
(74) *Attorney, Agent, or Firm* — Muncy, Geissler, Olds & Lowe, PLLC

(57) ABSTRACT

An inductance module includes a base holder and an inductance element. The inductance element is installed on a bottom base of the base holder and then a coil of the inductance element is electrically connected to the conductive pins of the bottom base. A positioning element of the base holder is fabricated on the bottom base to fix the inductance element and then the bottom base is installed in an opening of a circuit board, thus reducing the height of installing the inductance module on the circuit board after fabricating the base holder and the circuit board. The positioning element is designed like a barb to increase strength of fabricating the positioning element on the bottom base instead of using an adhesive, thus reducing working hours and simplifying working process.

10 Claims, 7 Drawing Sheets

INDUCTANCE MODULE AND BASE HOLDER THEREOF

BACKGROUND

1. Technical Field

The present disclosure relates generally to an inductance, and more particularly to an inductance module and a base holder thereof are provided to position an inductance element on a circuit board.

2. Description of Prior Art

Reference is made to FIG. 1 which is a perspective schematic view of a prior art inductance structure. The prior art inductance structure is a lying-type structure of the inductance 10. The inductance 10 has a cyclic iron core 101 and a coil 102, which is wound on the iron core 101. A coil-outgoing terminal 103 of the coil 102 passes through a through hole 201 of the circuit board 20 and electrically connects to the circuit board 20. A partition board 30 is inserted in a cyclic hole 104 of the iron core 101 of the inductance 10. However, the lying-type inductance 10 has the following disadvantages:

1. Manufacturing the conventional inductance structure spends more working hours and needs more complicated working process;

2. Because the conventional inductance 10 is directly electrically connected on the circuit board 20, the height of fabricating the inductance 10 on the circuit board 20 is too high to minify and lighten the electronic apparatus;

3. The coil-outgoing terminal 103 of the conventional inductance 10 is not easily fixed by using only the circuit board; and 4. After fabricating the partition board 30 in the cyclic hole 104, an adhesive needs to be used between the coil 102 and the partition board 30, thus increasing manufacture costs and working hours.

BRIEF SUMMARY

Accordingly, an object of the present disclosure is to overcome the existing disadvantages of the conventional inductance structure. An inductance structure of the present disclosure is designed to simplify the manufacture process, thus meeting the demand of reducing height after fabricating the inductance structure on the circuit board. Instead of using an adhesive to fix the inductance structure, positioning elements are designed like a barb to increase the force, thus reducing manufacture costs and working hours. A coil-outgoing terminal of the coil of the inductance structure is directly electrically connected to the conductive pins to accurately fix the coil-outgoing terminal and the pin pitch thereof.

Another object of the present disclosure is to provide a height standard for easily checking whether a height of winding the coil on an iron core is too high or not by using the positioning elements.

In order to achieve the above-mentioned objects, a base holder is provided to position an inductance element. The base holder includes a bottom base and a positioning element. The bottom base has a containing portion with a containing space and an outer ring surface with an extending portion.

The positioning element has a girder portion and a wedging portion connected to the girder portion. The girder portion is connected to the outer ring surface of the containing portion. The wedging portion penetrates the containing space and clips the inductance element.

In order to achieve the above-mentioned objects, an inductance is provided. The inductance module includes an inductance element and a base holder. The base holder has a bottom base and a positioning element. The bottom base is installed on the circuit board and the bottom base has a containing portion. The containing portion has a containing space and an outer ring surface with an extending portion.

The position element has a girder portion and a wedging portion connected to the girder portion. The girder portion is connected on the outer ring surface of the containing portion. The wedging portion penetrates the containing space and clips the inductance element.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes an exemplary embodiment of the disclosure, taken in conjunction with the accompanying drawings, in which:

DETAILED DESCRIPTION

Figure 1:
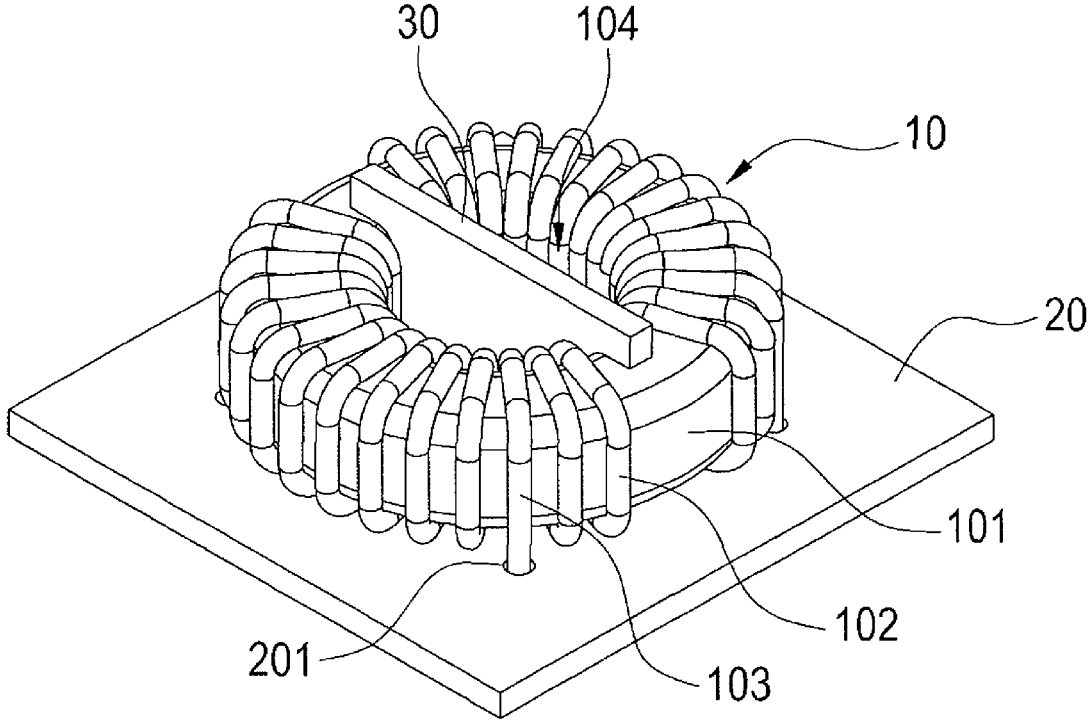
FIG.1 PRIOR ART
FIG. 1 is a perspective schematic view of a prior art inductance structure.

Reference will now be made to the drawing figures to describe the present disclosure in detail.

Figure 2:
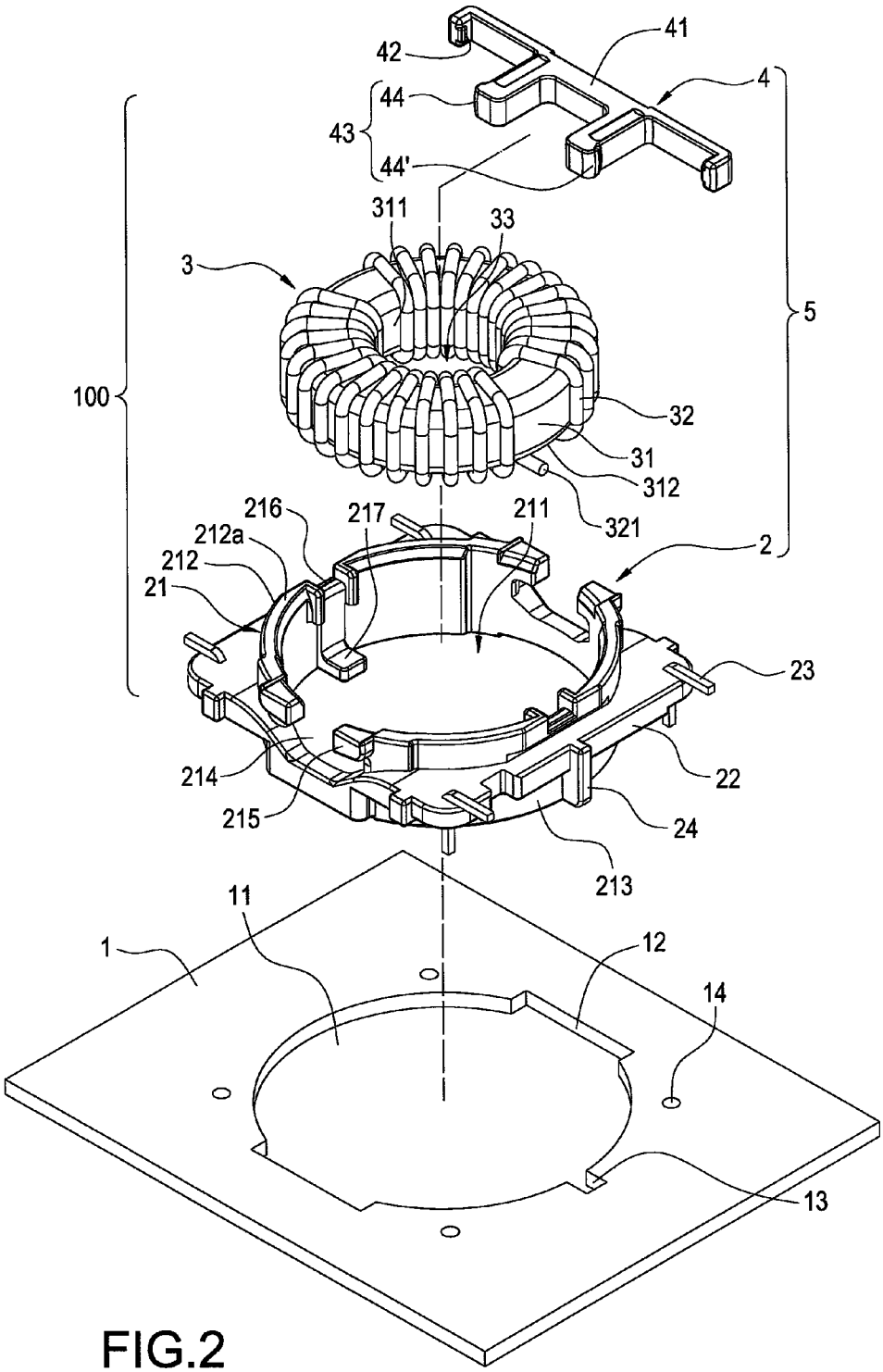
FIG. 2 is an exploded schematic view of an inductance structure according to a first embodiment of the present disclosure.
Figure 3:
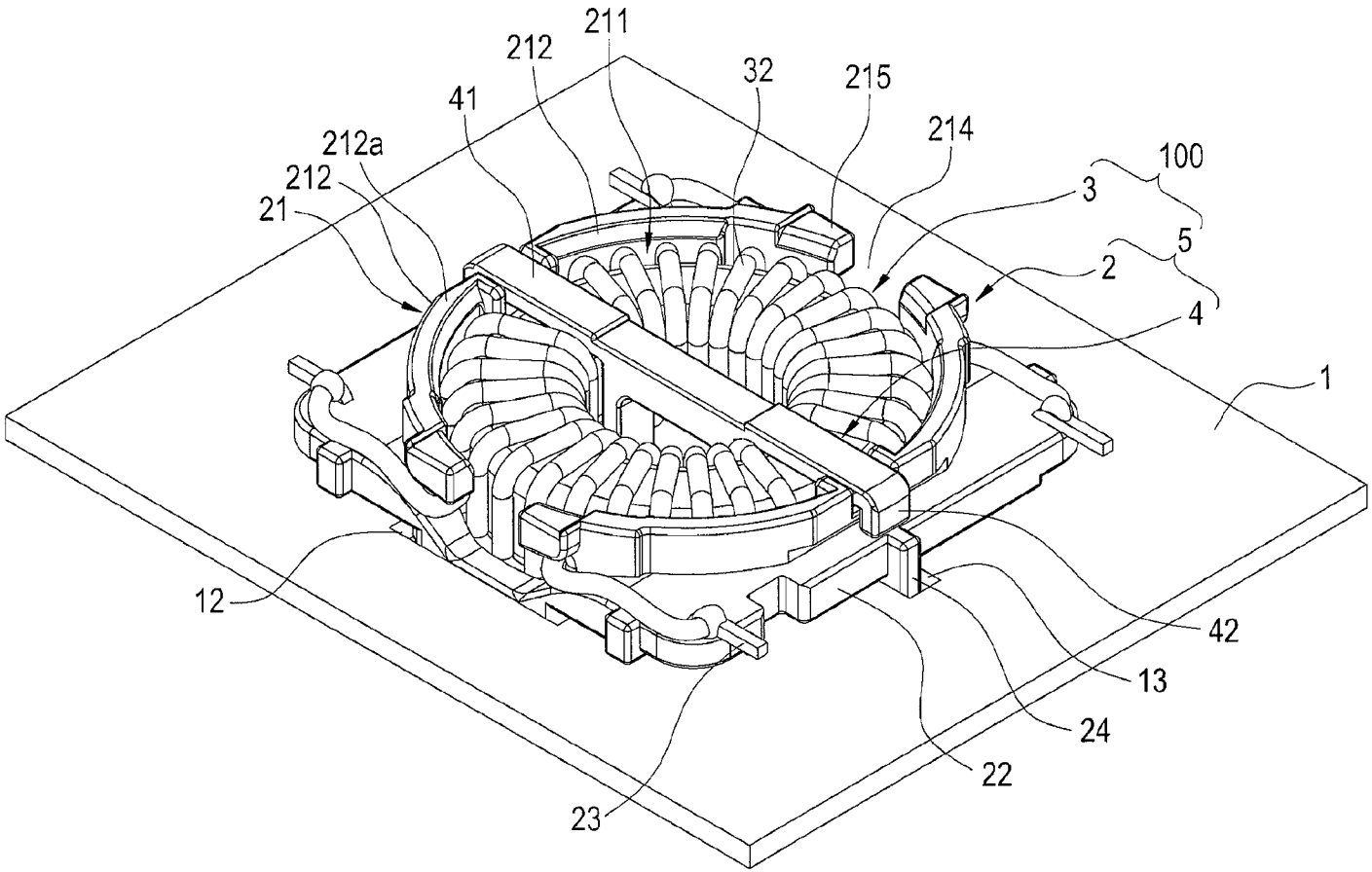
FIG. 3 is a perspective schematic view of the inductance structure according to the first embodiment of the present disclosure.

Reference is made to FIG. 2 and FIG. 3 which are an exploded schematic view and a perspective schematic view of an inductance structure according to a first embodiment of the present disclosure, respectively. The inductance module 100 is disposed on a circuit board 1. The inductance module 100 includes an inductance element 3 and a base holder 5. The base holder 5 has a bottom base 2 and a positioning element 4.

The circuit board 1 has a circular opening 11. The opening 11 has two concave portions 12, which are opposite to each other, and an idle-proof notch 13 around a peripheral edge thereof. The circuit board 1 further has a plurality of through holes 14 adjacent to the opening 11. The bottom base 2 is fabricated in the opening 11 of the circuit board 1. The bottom base 2 has a containing portion 21, an extending portion 22, four conductive pins 23, and a bump 24. The containing portion 21 has a containing space 211 therein and the inductance element 3 is contained in the containing space 211. A shape of an outer diameter of the containing portion 21 is identical to that of an inner diameter of the concave portion 12 as well as that of the opening 11 of the circuit board 1. The extending portion 22 is installed on an outer ring surface of the containing portion 21 to separate the outer ring surface of the containing portion 21 into an upper enclosure wall 212 and a lower enclosure wall 213. Each conductive pin 23 is L-shaped and the four conductive pins 23 are penetrated through selected positions, such as four corners of the extending portion 22 in this embodiment, and inserted into the corresponding through holes 14 of the circuit board 1. The bump 24 is disposed on the extending portion 22 and the lower enclosure wall 213. The containing portion 21 has a first surface 212*a* on the upper enclosure wall 212 thereof. A first fastening structure 216 is installed on the first surface 212*a* to fasten the positioning element 4. The containing space 211 has a holding structure 217, which is disposed on the lower enclosure wall 213 of the containing portion 21, to hold the inductance element 3.

The inductance element 3 has a substantially cyclic iron core 31 and a coil 32, which is wound on the iron core 31. Also, the iron core 31 has a cyclic hole 33 at the center thereof. The first surface 212*a* of the upper enclosure wall 212 has two coil-collecting slots 214, which are opposite to each other, and two stops 215, which are opposite to each other, are installed on the upper enclosure wall 212 and two sides of each coil-collecting slot 214. A coil-outgoing terminal 321 of the coil 32 passes through the coil-collecting slot 214 and electrically connects to the conductive pins 23.

The positioning element 4 is π-shaped and has a girder portion 41 and a wedging portion 43 which is connected to the girder portion 41. Each terminal of the girder portion 41 has a second fastening structure 42. The second fastening structure 42 of the girder portion 41 is fastened to the corresponding first fastening structure 216, thus connecting the girder portion 41 to the first surface 212*a* of the containing portion 21. The wedging portion 43 has a first hook 44 and a second hook 44'. The first hook 44 and the second hook 44' of the wedging portion 43 are penetrated in the containing space 211 and wedged on an inner cyclic surface 311 and a bottom surface 312 of the iron core 31.

Figure 4:
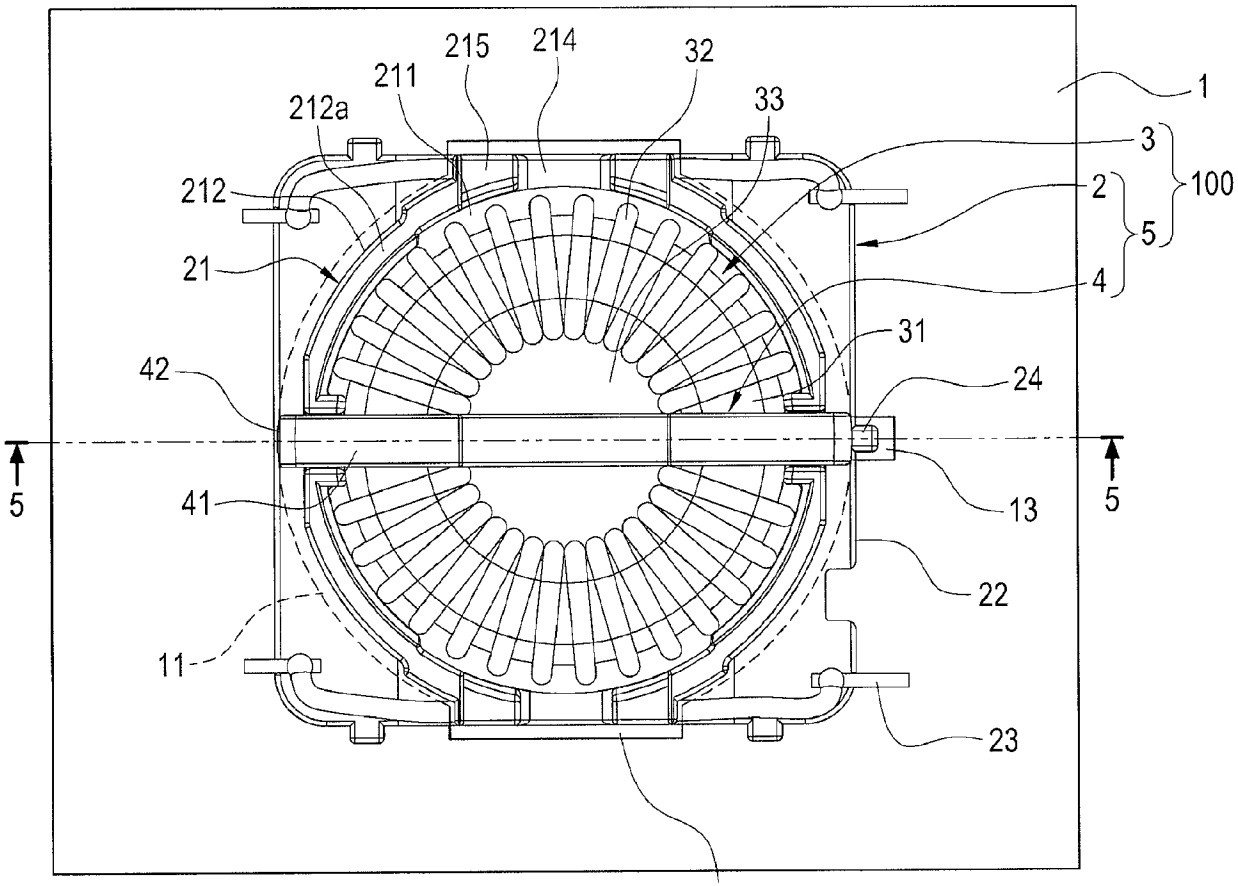
FIG. 4 is a top schematic view of the inductance structure according to the first embodiment of the present disclosure.
Figure 5:
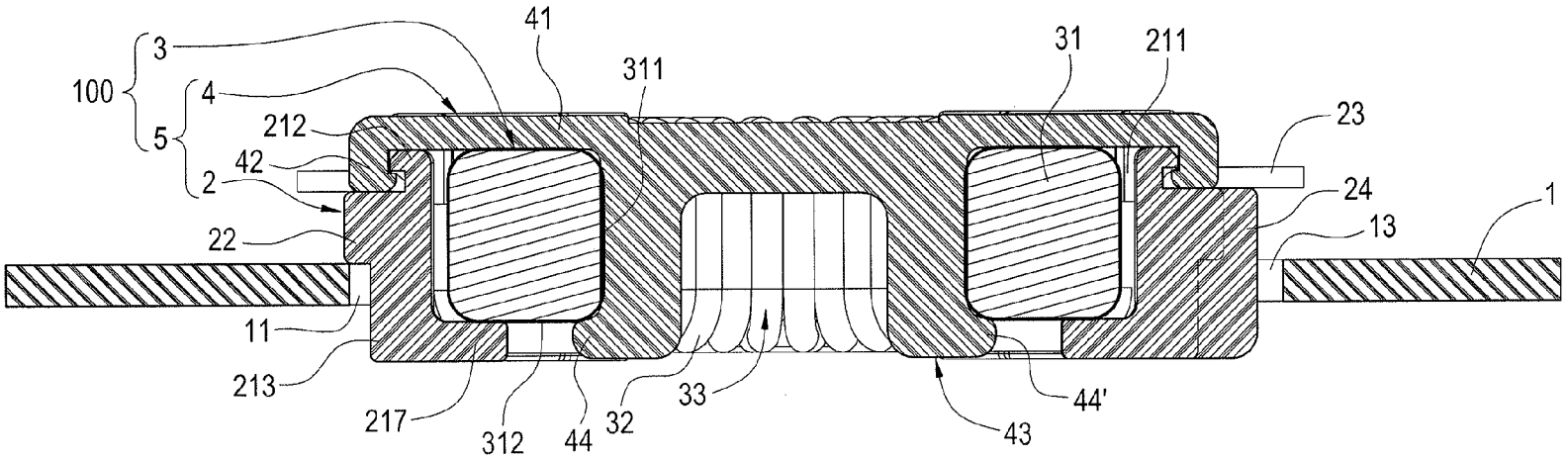
FIG. 5 is a cross-sectional schematic view taken along line 5-5 of FIG. 4.

Reference is made to FIG. 4 and FIG. 5 which are a top schematic view of the inductance structure according to the first embodiment of the present disclosure and a cross-sectional schematic view taken along line 5-5 of FIG. 4. The base holder 5, which is composed of the bottom base 2 and the positioning element 4, is provided to contain the inductance element 3. The inductance element 3 is contained in the containing space 211 of the containing portion 21 and then the inductance element 3 is held through the holding structure 217. The wedging portion 43 penetrates through the cyclic hole 33 and then the first hook 44 and the second hook 44' are wedged on the inner cyclic surface 311 and the bottom surface 312 of the iron core 31. Also, the second fastening structures 42, which are disposed on two terminals of the girder portion 41, are connected to the corresponding first fastening structure 216. Accordingly, the inductance element 3 is fixed and the coil 32 is separated. Instead of using an adhesive to fix the inductance element 3, the first hook 44 or the second hook 44' of the positioning element 4 are designed like a barb to increase the force of positioning the inductance element 3, thus reducing working hours and simplifying working process. The coil-outgoing terminal 321 of the coil 32 is directly electrically connected to the conductive pins 23 to accurately fix the coil-outgoing terminal 321 and the pin pitch thereof. Furthermore, the girder portion 41 of the positioning element 4 provides a height standard for easily checking whether a height of winding the coil 32 on the iron core 31 is too high or not. That is, the normal standard is met when the height of the winding the coil 32 on the iron core 31 is not to exceed the height of the girder portion 41.

After installing the bottom base 2, the inductance element 3 and the positioning element 4, the lower enclosure wall 213 of the containing portion 21 and the bump 24 are installed in the opening 11 of the circuit board 1 and the idle-proof notch 13, respectively, thus meeting the demand of reducing height after fabricating the inductance module 100 on the circuit board 1. Also, the L-shaped conductive pins 23 are inserted into the corresponding through holes 14 to electrically connect to the circuit board 1 when the lower enclosure wall 213 of the containing portion 21 and the bump 24 are installed in the opening 11 of the circuit board 1 and the idle-proof notch 13, respectively.

Figure 6:
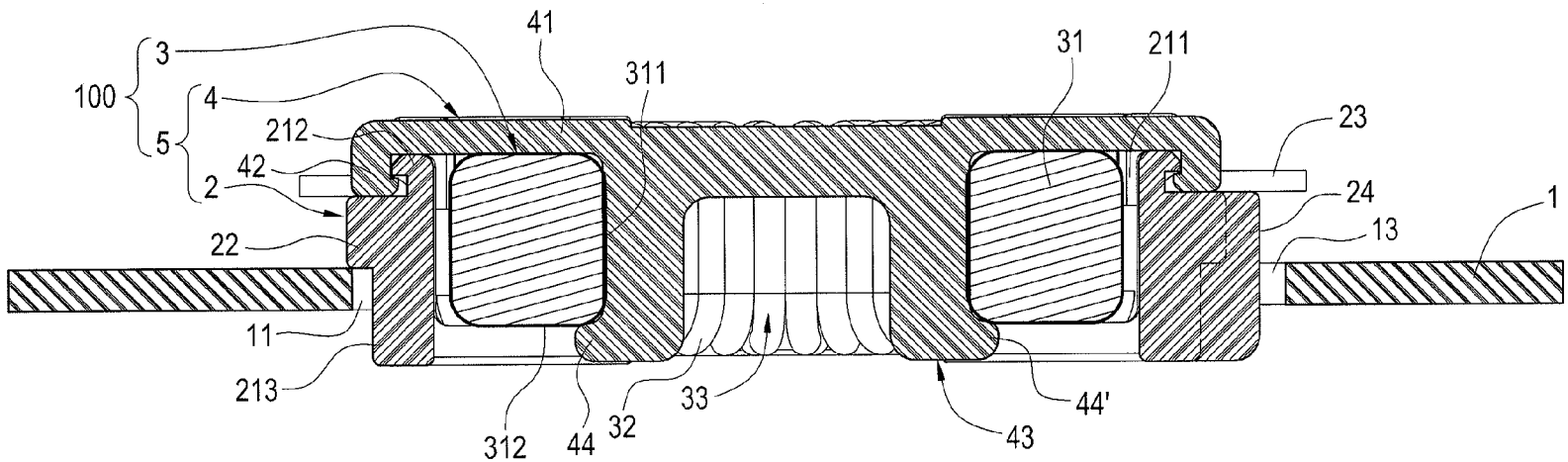
FIG. 6 is a cross-sectional schematic view according to a second embodiment of the present disclosure.

Reference is made to FIG. 6 which is a cross-sectional schematic view according to a second embodiment of the present disclosure. The major difference between the second embodiment and the above-mentioned first embodiment is that the inductance element 3 is wedged in the containing space 211 of the containing portion 21 through the first hook 44 and the second hook 44' without using the holding structure 217.

Figure 7:
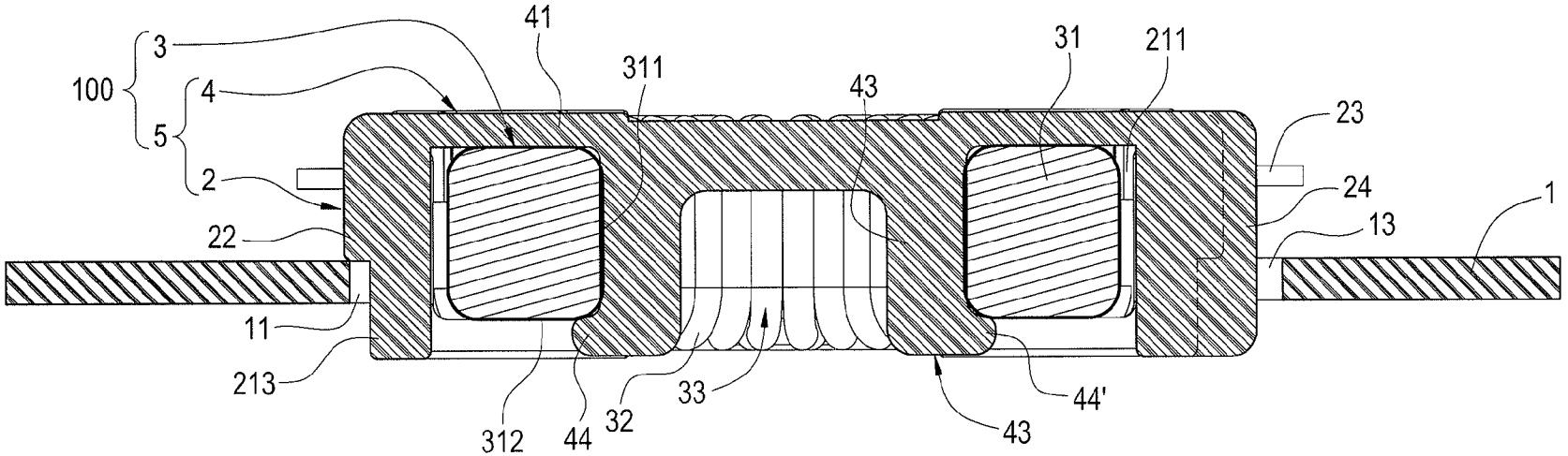
FIG. 7 is a cross-sectional schematic view according to a third embodiment of the present disclosure.

Reference is made to FIG. 7 which is a cross-sectional schematic view according to a third embodiment of the present disclosure. The bottom base 2 and the positioning element 4 are designed in integrated injection molding by a mold. Hence, the working hours would be reduced and the working process would be simplified to decrease manufacture costs. After manufacturing the base holder 5, the girder portion 41 of the positioning element 4 is directly connected on the first surface 212*a* of the containing portion 21. Also, the inductance element 3 is directly installed and wedged in the containing space 211 of the containing portion 21 through the first hook 44 and the second hook 44'.

Figure 8:
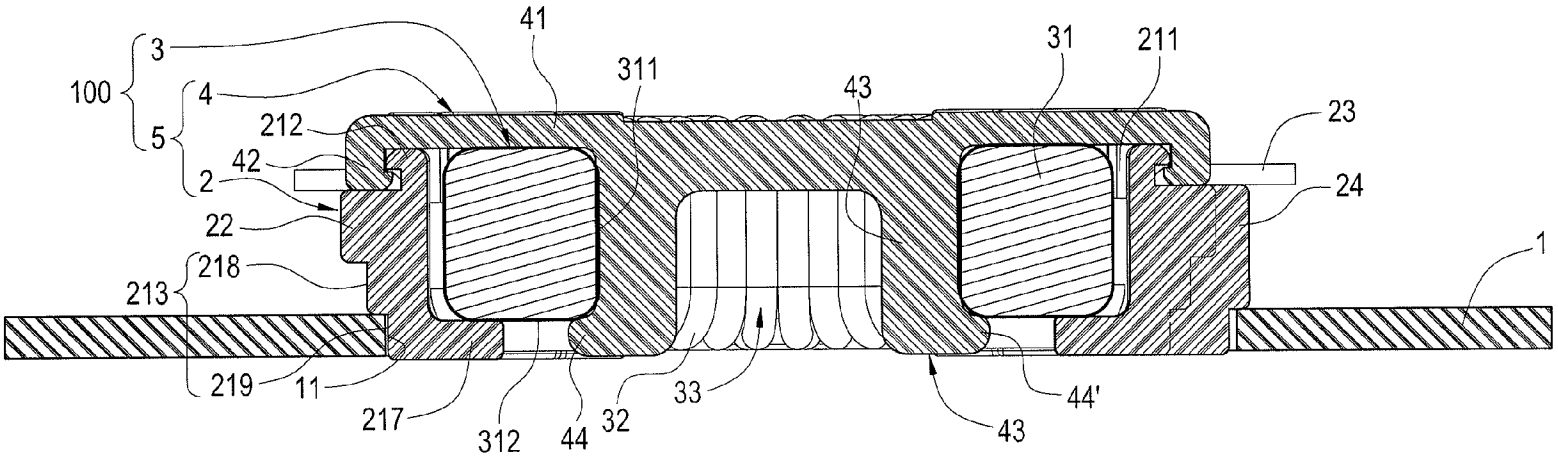
FIG. 8 is a cross-sectional schematic view according to a fourth embodiment of the present disclosure.

Reference is made to FIG. 8 which is a cross-sectional schematic view according to a fourth embodiment of the present disclosure. The lower enclosure wall 213 of the containing portion 21 has a first joint portion 218 and a second joint portion 219. The first joint portion 218 is adjacent to the extending portion 22 and the second joint portion 219 is connected to the first joint portion 218. An outer diameter of the extending portion 22 is greater than that of the first joint portion 218, and the outer diameter of the first joint portion 218 is greater than that of the second joint portion 219. In this embodiment, a hole diameter of the opening 11 of the circuit board 1 is designed between the outer diameter of the first joint portion 218 and that of the second joint portion 219, thus being able to install the first joint portion 218 on a surface around the opening 11 of the circuit board 1. In another embodiment, the hole diameter of the opening 11 of the circuit board 1 is designed between the outer diameter of the extending portion 22 and that of the first joint portion 218, thus being able to install the extending portion 22 on the surface around the opening 11 of the circuit board 1. Accordingly, the height of fabricating the inductance module 100 on the circuit board 1 can be adjusted to meet the demand of fabrication space inside an electronic apparatus.

Figure 9:
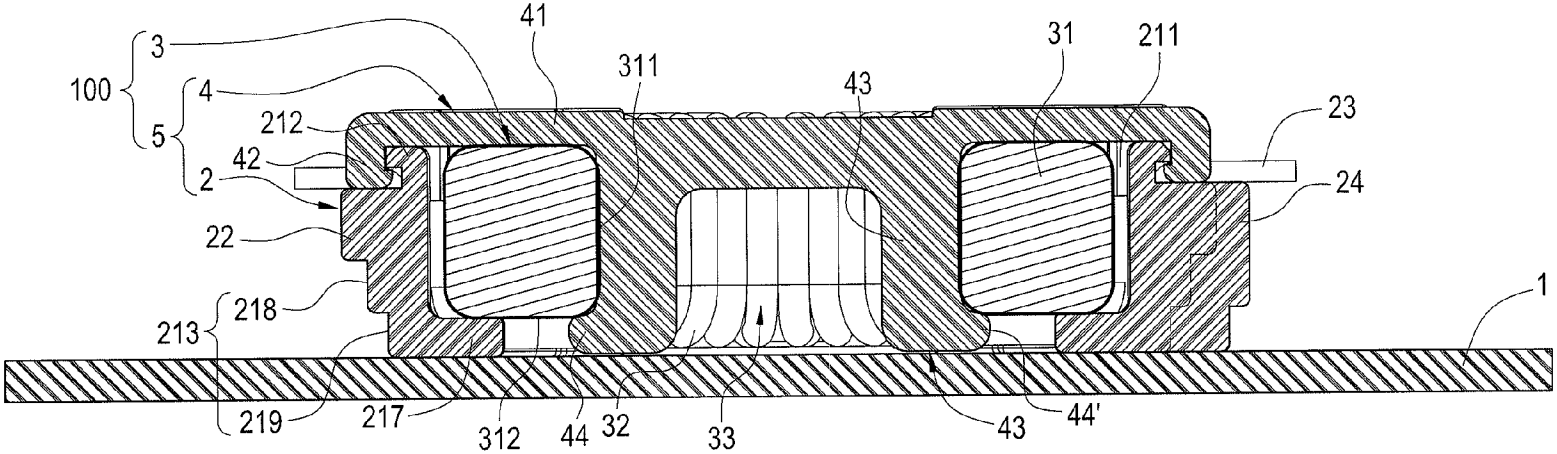
FIG. 9 is a cross-sectional schematic view according to a fifth embodiment of the present disclosure.

Reference is made to FIG. 9 which is a cross-sectional schematic view according to a fifth embodiment of the present disclosure. The bottom base 2 can be directly installed on the surface of the circuit board 1 without forming the opening 11 on the circuit when the height of installing the bottom base 2 on the circuit board 1 is sufficient.

Although the present disclosure has been described with reference to the preferred embodiment thereof, it will be understood that the disclosure is not limited to the details thereof. Various substitutions and modifications have been suggested in the foregoing description, and others will occur to those of ordinary skill in the art. Therefore, all such substitutions and modifications are intended to be embraced within the scope of the disclosure as defined in the appended claims.

What is claimed is:

1. A base holder provided to position an inductance element, the inductance element having a cyclic hole, the base holder comprising:

a bottom base having a containing portion, and the containing portion having a containing space and a first surface, the inductance element contained in the containing space, the bottom base having a first fastening structure defined on the containing portion; and a positioning element having a girder portion and a wedging portion first hook and a second hook connected in one-piece form with the girder portion, the girder portion connected on the first surface of the containing portion, the wedging portion first hook and the second hook penetrates the containing space and the cyclic hole of the inductance and clips the inductance element, wherein the girder portion has a second fastening structure engaged with the first fastening structure.

2. The base holder of claim 1, wherein the first surface of the containing portion has the first fastening structure, the positioning element is fastened to the first fastening structure through the second fastening structure of the girder portion, the containing space has a holding structure connected to the containing portion, and the holding structure supports the inductance element.

3. The base holder of claim 1, wherein the base holder is disposed on a circuit board, the circuit board has an opening and a plurality of through holes formed around the opening, the containing portion is disposed in the opening of the circuit board, the bottom base further has an extending portion installed on an outer ring surface of the containing portion and a plurality of conductive pins disposed in the extending portion, the conductive pins are inserted in the through holes.

4. The base holder of claim 3, wherein the containing portion has a first joint portion and a second joint portion, the first joint portion is adjacent to the extending portion, the second joint portion is connected to the first joint portion, an outer diameter of the extending portion is greater than that of the first joint portion, and the outer diameter of the first joint portion is greater than that of the second joint portion, a hole diameter of the opening of the circuit board is between an outer diameter of the extending portion and that of the first joint portion or between the outer diameter of the first joint portion and that of the second joint portion, so that the extending portion is installed on a surface around the opening of the circuit board or the first joint portion is installed on the surface around the opening of the circuit board.

5. The base holder of claim 3, wherein the first surface of the containing portion further has two coil-collecting slots, the inductance element has a substantially cyclic iron core and a coil wound on the iron core, a coil-outgoing terminal of the coil passes through the coil-collecting slot and electrically connects to the conductive pins, the wedging portion has the first hook and the second hook which are wedged on an inner cyclic surface and a bottom surface of the iron core.

6. An inductance module comprising:

an inductance element having a cyclic hole, and a base holder comprising:

a bottom base having a containing portion, and the containing portion having a containing space and a first surface, the inductance element contained in the containing space, the bottom base having a first fastening structure defined on the containing portion; and a positioning element having a girder portion and a wedging portion first hook and a second hook connected in one-piece form with the girder portion, the girder portion connected on the first surface of the containing portion, the wedging portion first hook and the second hook penetrates the containing space and the cyclic hole of the inductance element and clips the inductance element, wherein the girder portion has a second fastening structure engaged with the first fastening structure.

7. The inductance module of claim 6, wherein the first surface of the containing portion has the first fastening structure, the positioning element is fastened to the first fastening structure through the second fastening structure of the girder portion, the containing space has a holding structure connected to the containing portion, and the holding structure supports the inductance element.

8. The inductance module of claim 6, wherein the inductance module is disposed on a circuit board, the circuit board has an opening and a plurality of through holes formed around the opening, the containing portion is disposed in the opening of the circuit board, the bottom base further has an extending portion installed on an outer ring surface of the containing portion and a plurality of conductive pins disposed in the extending portion, the conductive pins are inserted in the through holes.

9. The inductance module of claim 8, wherein the containing portion has a first joint portion and a second joint portion, the first joint portion is adjacent to the extending portion, the second joint portion is connected to the first joint portion, an outer diameter of the extending portion is greater than that of the first joint portion and the outer diameter of the first joint portion is greater than that of the second joint portion, a hole diameter of the opening of the circuit board is between an outer diameter of the extending portion and that of the first joint portion or between the outer diameter of the first joint portion and that of the second joint portion, so that the extending portion is installed on a surface around the opening of the circuit board or the first joint portion is installed on the surface around the opening of the circuit board.

10. The inductance module of claim 8, wherein the first surface of the containing portion further has two coil-collecting slots, the inductance element has a substantially cyclic iron core and a coil wound on the iron core, a coil-outgoing terminal of the coil passes through the coil-collecting slot and electrically connects to the conductive pins, the wedging portion has the first hook and the second hook which are wedged on an inner cyclic surface and a bottom surface of the iron core.

* * * * *